US011064806B1

(12) United States Patent
Ge

(10) Patent No.: US 11,064,806 B1
(45) Date of Patent: Jul. 20, 2021

(54) COMBINED GOODS SUPPORT DEVICE

(71) Applicants: Qingdao Lanshan Trade Co., Ltd., Qingdao (CN); Qingdao Fuyou Tools Co., Ltd., Qingdao (CN)

(72) Inventor: Zhiqiang Ge, Qingdao (CN)

(73) Assignees: QINGDAO LANSHAN TRADE CO., LTD., Qingdao (CN); QINGDAO FUYOU TOOLS CO., LTD., Qingdao (CN)

( * ) Notice: Subject to any disclaimer, the term of this patent is extended or adjusted under 35 U.S.C. 154(b) by 0 days.

(21) Appl. No.: 16/901,396

(22) Filed: Jun. 15, 2020

(30) Foreign Application Priority Data

Apr. 30, 2020 (CN) ..... 202020701886.3

(51) Int. Cl.
*A47B 87/02* (2006.01)
*A47B 96/14* (2006.01)
*A47B 47/00* (2006.01)

(52) U.S. Cl.
CPC ..... *A47B 87/0207* (2013.01); *A47B 47/0083* (2013.01); *A47B 96/1408* (2013.01)

(58) Field of Classification Search
CPC ..... A47B 87/0215; A47B 87/0207; A47B 87/0246; A47B 47/0083; A47B 96/1408; A47B 96/145; A47F 5/14; A47F 5/101
See application file for complete search history.

(56) References Cited

U.S. PATENT DOCUMENTS 4,582,001 A * 4/1986 Leikarts ..... A47B 57/265 108/106
5,425,520 A * 6/1995 Masumoto ..... A47B 96/06 248/247
5,463,966 A * 11/1995 Nilsson ..... F16B 12/34 108/110
5,553,549 A * 9/1996 Nilsson ..... A47B 9/00 100/144
5,971,175 A * 10/1999 Bustos ..... A47F 5/13 211/187
6,397,413 B2 * 6/2002 Epstein ..... A47C 19/025 5/201
D690,189 S * 9/2013 Wojtowicz ..... D8/394
(Continued)

*Primary Examiner* — Patrick D Hawn
(74) *Attorney, Agent, or Firm* — Hauptman Ham, LLP

(57) ABSTRACT

A combined goods support device includes at least two vertically-stacked goods support frames, wherein every two adjacent goods support frames are connected by a plurality of goods support frame connectors; the goods support frame includes four first L-shaped support plates, and goods placement racks are disposed among the four first L-shaped support plates; the goods support frame connector is presented in the form of L-shaped plate, a first insertion groove and a second insertion groove for connecting the first L-shaped support plates are opened at upper and lower ends of the goods support frame connector respectively, and the first insertion groove and the second insertion groove are mirror-symmetrically disposed relative to a middle portion of the goods support frame connector; the first insertion groove is an L-shaped groove that is wide at an outer end and narrow at an inner end, and the second insertion groove is an L-shaped groove that is wide at an outer end and narrow at an inner end. The goods support device is simple and novel in structure, high in stability and easy to assemble and disassemble.

2 Claims, 3 Drawing Sheets

(56) References Cited

U.S. PATENT DOCUMENTS

| | | | | |
|---|---|---|---|---|
| D690,582 | S * | 10/2013 | Wojtowicz | D8/394 |
| 8,585,313 | B2 * | 11/2013 | Wojotowicz | A47F 5/14 403/293 |
| 8,672,577 | B2 * | 3/2014 | Wojtowicz | A47F 5/14 403/286 |
| 8,714,864 | B2 * | 5/2014 | Wojtowicz | A47F 5/14 403/286 |
| 9,101,216 | B2 * | 8/2015 | Fitzgerald | A47B 96/06 |
| 9,144,303 | B2 * | 9/2015 | Eustace | A47B 57/22 |
| 9,439,508 | B2 * | 9/2016 | Wojtowicz | A47F 5/14 |
| 9,474,369 | B1 * | 10/2016 | Tsai | A47F 5/10 |
| 9,717,330 | B2 * | 8/2017 | Reinhart | A47B 47/047 |
| 9,723,925 | B1 * | 8/2017 | Tsai | A47B 47/00 |
| 9,788,650 | B2 * | 10/2017 | Tsai | A47F 5/101 |
| 10,058,171 | B2 * | 8/2018 | Deng | A47B 96/021 |
| 10,448,536 | B2 * | 10/2019 | Dlugosz | B62B 1/10 |
| 10,626,905 | B1 * | 4/2020 | Chiu | A47B 57/545 |
| 10,694,849 | B2 * | 6/2020 | Liss | A47B 47/021 |
| 2010/0084354 | A1 * | 4/2010 | Eustace | A47B 96/1441 211/134 |
| 2011/0272373 | A1 * | 11/2011 | Wojtowicz | A47F 5/14 211/134 |
| 2011/0272541 | A1 * | 11/2011 | Wojtowicz | A47B 87/0215 248/218.4 |
| 2011/0272542 | A1 * | 11/2011 | Wojtowicz | A47F 5/14 248/218.4 |
| 2011/0272543 | A1 * | 11/2011 | Wojtowicz | A47B 87/0215 248/218.4 |
| 2014/0154001 | A1 * | 6/2014 | Wojtowicz | A47B 87/0215 403/293 |
| 2017/0208937 | A1 * | 7/2017 | Tsai | A47B 47/021 |
| 2017/0208949 | A1 * | 7/2017 | Tsai | A47B 43/00 |
| 2017/0211604 | A1 * | 7/2017 | Tsai | A47B 47/0083 |
| 2019/0059588 | A1 * | 2/2019 | Liss | A47B 96/1408 |
| 2020/0297113 | A1 * | 9/2020 | Liss | A47B 96/1441 |

* cited by examiner

COMBINED GOODS SUPPORT DEVICE

TECHNICAL FIELD

The present utility model relates to the field of machinery, and in particular to a combined goods support device.

BACKGROUND

With development of economy, supportive material warehousing is also developing rapidly. Goods are generally stored on goods shelves in factory buildings or warehouses. Generally, the main body of the goods shelf is of an integral connection structure. Under normal circumstances, the shelves are assembled in a processing plant and then transported to the factory of a target customer. However, because some goods shelves are relatively high, transportation of the assembled goods shelves is troublesome and high in costs. Further, the integrated goods shelves have a low utilization rate in a later period. The goods shelves cannot be circulated for use in small warehouses due to their heights after being used in large warehouses.

SUMMARY

An object of the present utility model is to provide a combined goods support device that is simple and novel in structure, high in stability and easy to assemble and disassemble.

To achieve the above object, the present utility model adopts the following solution.

A combined goods support device includes at least two vertically-stacked goods support frames, where every two adjacent goods support frames are connected by a plurality of goods support frame connectors; the goods support frame includes four first L-shaped support plates, and a goods placement rack is disposed among four first L-shaped support plates; the goods support frame connector is presented in the form of L-shaped plate, a first insertion groove and a second insertion groove for connecting the first L-shaped support plates are opened at upper and lower ends of the goods support frame connector, and the first insertion groove and the second insertion groove are mirror-symmetrically disposed relative to a middle portion of the goods support frame connector; the first insertion groove is an L-shaped groove that is wide at an outer end and narrow at an inner end, and the second insertion groove is an L-shaped groove that is also wide at an outer end and narrow at an inner end.

Preferably, the first L-shaped support plate is made of a corner steel plate, and the first L-shaped support plate includes a first transverse plate portion and a first longitudinal plate portion. A plurality of first hardy holes are opened in the first transverse plate portion, and the plurality of first hardy holes are linearly and vertically arranged. A plurality of second hardy holes are opened in the first longitudinal plate portion, and the plurality of second hardy holes are linearly and vertically arranged.

Preferably, the goods placement rack includes a first square frame, a first upper support board and a first lower connection board are fixedly connected at an inner side of the first square frame, and the first upper support board and the first lower connection board are both rectangular boards.

A first support board notch is opened at each of four corners of the first upper support board, and a first frame connection hole is opened on the first square frame that is at an inner side of the first support board notch. A second support board notch is opened at each of four corners of the first lower connection board, and a second frame connection hole is opened on the first square frame that is at an inner side of the second support board notch.

Preferably, first goods support frame connection bolts are disposed within the first frame connection hole and the second frame connection hole respectively, and the first square frame is in positioning connection with the first hardy holes and the second hardy holes through the first goods support frame connection bolts.

Preferably, the goods support frame connector is made of a polypropylene material. The first insertion groove includes a first transverse groove portion and a first longitudinal groove portion, the first transverse groove portion is communicated with one side of the first longitudinal groove portion, a width value of an outer end face of the first transverse groove portion is greater than a width value of an inner end face of the first transverse groove portion, and a width value of an outer end face of the first longitudinal groove portion is greater than a width value of an inner end face of the first longitudinal groove portion.

Preferably, the second insertion groove includes a second transverse groove portion and a second longitudinal groove portion, the second transverse groove portion is communicated with one side of the second longitudinal groove portion, a width value of a outer end face of the second transverse groove portion is greater than a width value of an inner end face of the second transverse groove portion, and a width value of a outer end face of the second longitudinal groove portion is greater than a width value of an inner end face of the second longitudinal groove portion.

Preferably, two goods placement racks are provided, and the two goods placement racks are connected at an upper inner side and a lower inner side of the first L-shaped support plate respectively; the two goods placement racks are disposed in parallel with each other.

Preferably, a first structure-reinforcing partition plate is disposed within the goods support frame connector between the first insertion groove and the second insertion groove.

The present utility model has the following beneficial effects.

During installation of the above combined goods support device, two goods support frames 1 are fixedly connected through four goods support frame connectors. One goods support frame is connected above the other goods support frame through four goods support frame connectors. When the two goods support frames are connected, a lower end of the first L-shaped support plate of one goods support frame is inserted into the first insertion groove, and an upper end of the first L-shaped support plate of the other goods support frame is inserted into the second insertion groove. The first insertion groove and the second insertion groove in the present utility model are both an L-shaped groove that is wide at an outer end and narrow at an inner end. After the first L-shaped support plate is inserted into the insertion groove, the first L-shaped support plate will be fastened more tightly with more presses, and the entire structural stability of the goods support frame will be guaranteed along with increase of goods on the goods support frame. For the strength of the connection structure of the good support frame connector, the first structure-reinforcing partition plate may be disposed within the goods support frame connector between the first insertion groove and the second insertion groove.

In the present utility model, polypropylene (PP) material is used as the main material of the goods support frame connector connecting the upper and lower first L-shaped support plates to replace an original iron piece. The connector has advantages of light weight, low costs, high efficiency production and ease of installation and can fully satisfy load-bearing requirements of the goods support frames. The connector is an injection-moulded part, and grooves on both ends of the connector are in a shape which is wide at the outer end and narrow at the inner end. In this case, the stability of the goods support frames is increased and the bearing capacities of the goods support frames are guaranteed. Further, the partition plate is disposed in the middle of the connector to ensure the same sizes of the upper and lower first L-shaped support plates inserted into the connector.

BRIEF DESCRIPTION OF THE DRAWINGS

To describe the technical solutions in embodiments of the present utility model or in the prior art more clearly, drawings required in descriptions of the embodiments of the present utility model or the prior art will be briefly introduced below. It is apparent that the drawings described below are some embodiments of the present utility model and other drawings may be obtained by those of ordinary skill in the art based on these drawings without paying creative work.

DETAILED DESCRIPTION OF THE EMBODIMENTS

The present utility model provides a combined goods support device. To understand the objects, technical solutions and effects of the present utility model more clearly, the present utility model will be further described in detail below. It is to be understood that specific embodiments described herein are only used to explain the present utility model rather than limit the present utility model.

The present utility model is described in detail below in combination with the drawings.

Figure 1:
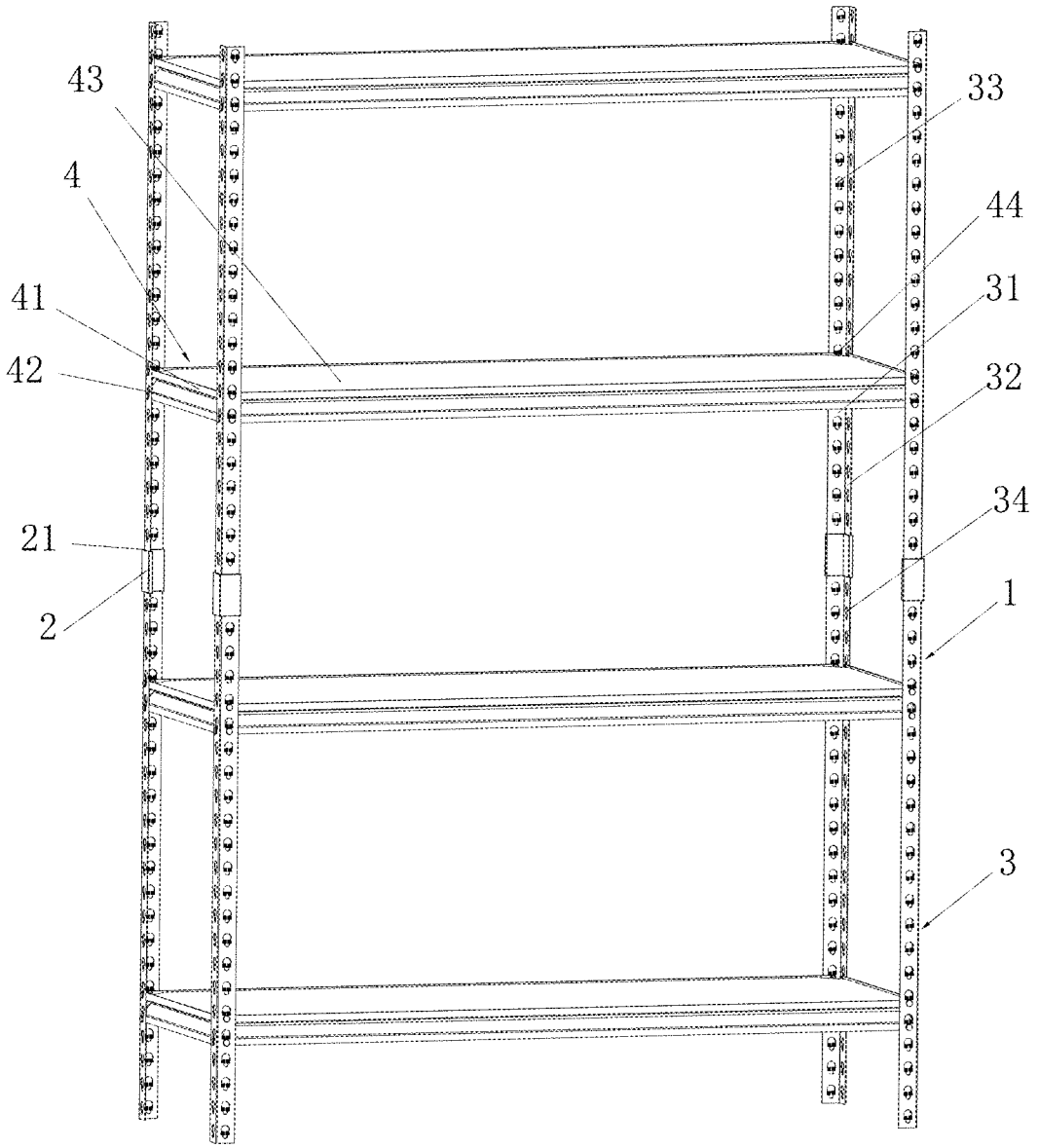
FIG. 1 is a schematic diagram illustrating an overall structure of a combined goods support device.
Figure 2:
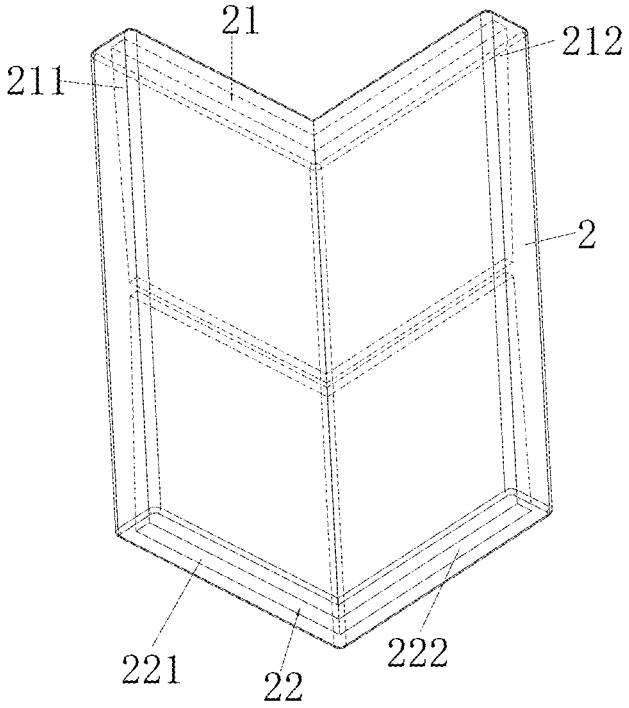
FIG. 2 is a schematic diagram illustrating an overall structure of a goods support frame connector.
Figure 3:
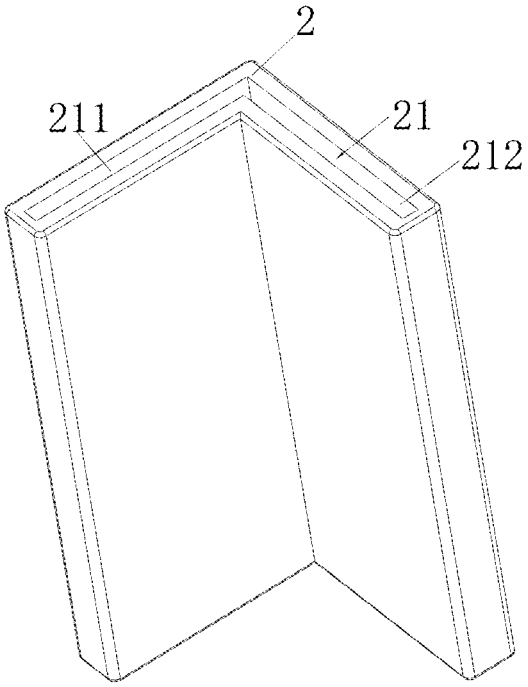
FIG. 3 is a top view of a goods support connector.
Figure 4:
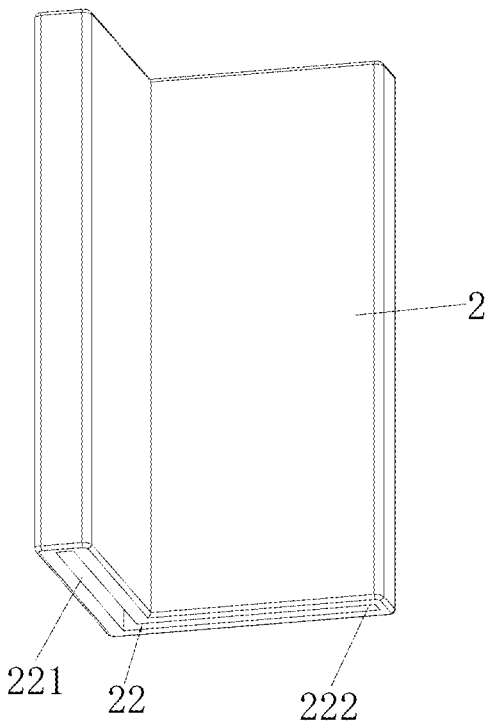
FIG. 4 is a bottom view of a goods support connector.
Figure 5:
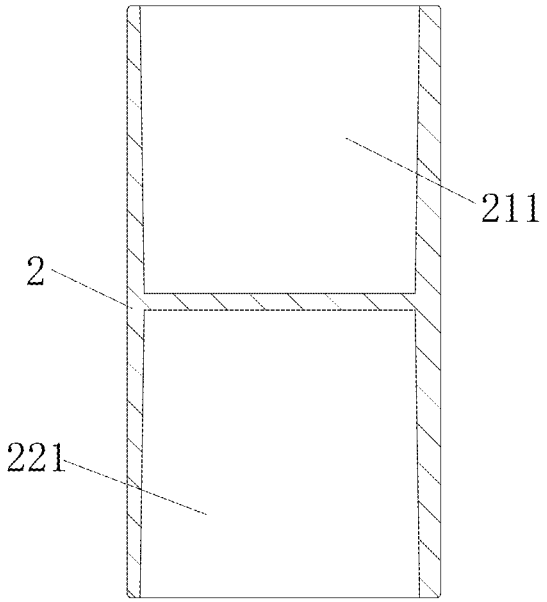
FIG. 5 is a sectional view of structural positions of a first transverse groove portion and a second transverse groove portion.

As shown in FIGS. 1-5, a combined goods support device includes at least two vertically-stacked goods support frames 1, and every two adjacent goods support frames 1 are connected by a plurality of goods support frame connectors 2. The goods support frame 1 includes four first L-shaped support plates 3, and a goods placement rack 4 is disposed among the four first L-shaped support plates 3.

The goods support frame connector 2 is presented in the form of L-shaped plate, a first insertion groove 21 and a second insertion groove 22 for connecting the first L-shaped support plates 3 are disposed at upper and lower ends of the goods support frame connector 2 respectively, and the first insertion groove 21 and the second insertion groove 22 are mirror-symmetrically disposed relative to a middle portion of the goods support frame connector 2. The first insertion groove is an L-shaped groove which is wide at the outer end and narrow at the inner end, and the second insertion groove is an L-shaped groove which is also wide at the outer end and narrow in the inner end.

The first L-shaped support plate 3 is made of a corner steel plate, and the first L-shaped support plate 3 includes a first transverse plate portion 31 and a first longitudinal plate portion 32. A plurality of first hardy holes 33 are opened in the first transverse plate portion 31, and the plurality of first hardy holes 33 are linearly and vertically arranged. A plurality of second hardy holes 34 are opened in the first longitudinal plate portion 32, and the plurality of second hardy holes 34 are linearly and vertically arranged.

The goods placement rack 4 includes a first square frame 41, a first upper support board 42 and a first lower connection board 43 are fixedly connected at an inner side of the first square frame 41, and the first upper support board 42 and the first lower connection board 43 are both rectangular boards.

A first support board notch is opened at each of four corners of the first upper support board 42, and a first frame connection hole is opened on the first square frame 41 at an inner side of the first support board notch. A second support board notch is opened at each of four corners of the first lower connection board 43, and a second frame connection hole is opened on the first square frame 41 at an inner side of the second support board notch.

First goods support frame connection bolts 44 are disposed within the first frame connection hole and the second frame connection hole respectively, and the first square frame 41 is in positioning connection with the first hardy holes 33 and the second hardy holes 34 through the first goods support frame connection bolts 44.

The goods support frame connector 2 is made of a polypropylene material. The first insertion groove 21 includes a first transverse groove portion 211 and a first longitudinal groove portion 212, the first transverse groove portion 211 is communicated with one side of the first longitudinal groove portion 212, a width value of an outer face of the first transverse groove portion 211 is greater than a width value of an inner end face of the first transverse groove portion 211, and a width value of an outer end face of the first longitudinal groove portion 212 is greater than a width value of an inner end face of the first longitudinal groove portion 212.

The second insertion groove 22 includes a second transverse groove portion 221 and a second longitudinal groove portion 222, the second transverse groove portion 221 is communicated with one side of the second longitudinal groove portion 222, a width value of a outer end face of the second transverse groove portion 221 is greater than a width value of an inner end face of the second transverse groove portion 221, and a width value of a outer end face of the second longitudinal groove portion 222 is greater than a width value of an inner end face of the second longitudinal groove portion 222.

There are two goods placement racks 4 in each goods support frame 1, and two goods placement racks 4 are connected at an upper inner side of the first L-shaped support plate 3 and a lower inner side of the first L-shaped support plate 3 respectively; two goods placement racks 4 are disposed in parallel with each other. A first structure-reinforcing partition plate is disposed within the goods support frame connector 2 between the first insertion groove 21 and the second insertion groove 22.

During installation of the above combined goods support device, two goods support frames 1 are fixedly connected through four goods support frame connectors. One goods support frame is connected above the other goods support frame through four goods support frame connectors. When two goods support frames are connected, the lower end of the first L-shaped support plate of one goods support frame is inserted into the first insertion groove, and the upper end of the first L-shaped support plate of the other goods support frame is inserted into the second insertion groove. The first insertion groove and the second insertion groove in the present utility model are both an L-shaped groove that is wide at the outer end and narrow at the inner end.

After the first L-shaped support plate is inserted into the insertion groove, the first L-shaped support plate will be fastened more tightly with more presses, and the entire structural stability of the goods support frame will be guaranteed along with increase of goods on the goods support frame. For the strength of the connection structure of the good support frame connector, the first structure-reinforcing partition plate may be disposed within the goods support frame connector between the first insertion groove and the second insertion groove.

In the present utility model, polypropylene (PP) material is used as the main material of the goods support frame connector connecting the upper and lower first L-shaped support plates to replace an original iron piece. The connector has advantages of light weight, low costs, high efficiency production and ease of installation and can fully satisfy load-bearing requirements of the goods support frames. The connector is an injection-moulded part, and grooves on both ends of the connector are in a shape which is wide at the outer end and narrow in the inner end. In this case, the stability of the goods support frames is increased and the bearing capacities of the goods support frames are guaranteed. Further, the partition plate is disposed in the middle of the connector to ensure the same sizes of the upper and lower first L-shaped support plates inserted into the connector.

In the descriptions of the present utility model, it is to be understood that an orientation or position relationship indicated by terms such as "upper", "lower", "front", "rear", "left" and "right" is an orientation or position relationship shown based on the drawings, and is only used to facilitate describing the present utility model and simplifying the description rather than indicate or imply that a described device or element should have a particular orientation or be constructed and operated in the particular orientation, and thus shall not be understood as limiting to the present utility model.

Parts unmentioned in the present utility model may be realized by adopting or referring to the prior art.

Of course, the above descriptions are not limiting of the present utility model, and the present utility model is also not limited to the above embodiments. Changes, modifications, additions or substitutions made by those skilled in the art within the spirit and scope of the present utility model shall also be encompassed in the scope of protection of the present utility model.

The invention claimed is:

1. A combined goods support device, comprising at least two vertically-stacked goods support frames, wherein every two adjacent goods support frames are connected by a plurality of goods support frame connectors; the goods support frame comprises four first L-shaped support plates, and goods placement racks are disposed among the four first L-shaped support plates; the goods support frame connector is presented in the form of L-shaped plate, a first insertion groove and a second insertion groove for connecting the first L-shaped support plates are opened at upper and lower ends of the goods support frame connector, and the first insertion groove and the second insertion groove are mirror-symmetrically disposed relative to a middle portion of the goods support frame connector; the first insertion groove is an L-shaped groove that gradually narrows from top to bottom, and the second insertion groove is a L-shaped groove that gradually narrows from bottom to top;

the goods support frame connector is made of a polypropylene material, the first insertion groove comprises a first transverse groove portion and a first longitudinal groove portion, the first transverse groove portion is communicated with one side of the first longitudinal groove portion, a width value of an outer end face of the first transverse groove portion is greater than a width value of an inner end face of the first transverse groove portion, and a width value of an outer end face of the first longitudinal groove portion is greater than a width value of an inner end face of the first longitudinal groove portion; and the second insertion groove comprises a second transverse groove portion and a second longitudinal groove portion, the second transverse groove portion is communicated with one side of the second longitudinal groove portion, a width value of an outer end face of the second transverse groove portion is greater than a width value of an inner end face of the second transverse groove portion, and a width value of an outer end face of the second longitudinal groove portion is greater than a width value of an inner end face of the second longitudinal groove portion.

2. The combined goods support device according to claim 1, wherein a first structure-reinforcing partition plate is disposed within the goods support frame connector between the first insertion groove and the second insertion groove.

* * * * *